United States Patent [19]

Sime

[11] 4,358,087

[45] Nov. 9, 1982

[54] LIMIT SWITCH TRIPPING MECHANISM FOR LIFTING JACKS

[75] Inventor: Sylvan H. Sime, Walters, Minn.

[73] Assignee: Simes, Inc., Walters, Minn.

[21] Appl. No.: 204,507

[22] Filed: Nov. 6, 1980

Related U.S. Application Data

[62] Division of Ser. No. 75,652, Sep. 14, 1979, Pat. No. 4,277,656.

[51] Int. Cl.[3] ..... B66F 1/00

[52] U.S. Cl. ..... 254/1; 254/89 H

[58] Field of Search ..... 200/47, 153 T, 329, 200/332, 335; 254/89 H, 89 R, 105, 106, 108, 1

[56] References Cited

U.S. PATENT DOCUMENTS

| | | | |
|---|---|---|---|
| 1,224,652 | 5/1917 | Kocourek | 200/47 |
| 3,598,369 | 2/1969 | Yielding | 254/106 |
| 3,693,773 | 9/1972 | Wickham et al. | 200/47 |
| 3,752,947 | 8/1973 | Strobel | 200/332 |
| 4,063,056 | 12/1977 | Baker | 200/332 |

FOREIGN PATENT DOCUMENTS

| | | | |
|---|---|---|---|
| 782040 | 4/1968 | Canada | 306/299 |
| 1371470 | 9/1963 | France | 200/47 |

*Primary Examiner*—Robert C. Watson

*Attorney, Agent, or Firm*—Kinney, Lange, Braddock, Westman and Fairbairn

[57] ABSTRACT

A lifting jack has its upward and downward traveling distance controlled by means of a limit switch. The lifting jack has a base, an upright outer member rigidly connected to the base and an upright inner member movable coaxially within the outer member. An up stop and an adjustable down stop are rigidly attached to and move with the inner member. An adjustable mount is mounted in a fixed position on the outer member, and the limit switch is mounted in fixed position on the mount. A guide shoe assembly is pivotally connected to the mount and is oriented generally perpendicular to the direction of travel of the inner member. A stop engaging member at one end of the guide is positioned to engage the up stop and the down stop, and an arm guiding portion at the opposite end engages and guides an actuating arm of the limit switch. In operation, the guide (and therefore the actuating arm of the limit switch) is biased by garter springs which hold it in a normal position riding on the inner member which is generally perpendicular to the direction of travel of the inner member of the jack. When the stop engaging member engages the down stop, the stop engaging member moves downward and the arm guiding portion and the actuating arm move upward, thereby causing the limit switch to change from its normal state. Similarly, when the stop engaging member engages the up stop, it moves upward and the arm guiding portion and the arm move downward to cause a change in the state of the limit switch.

4 Claims, 6 Drawing Figures

FIG. 1
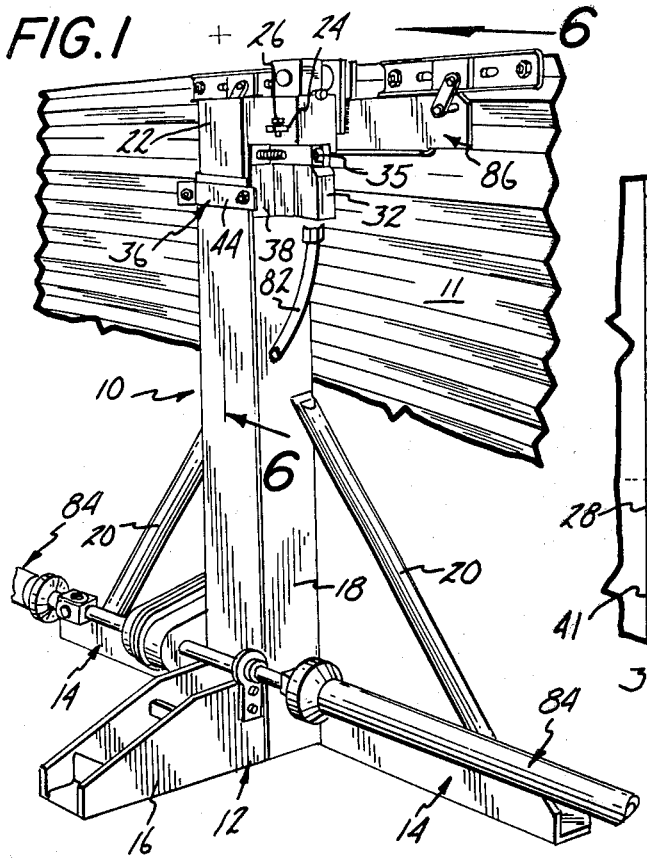
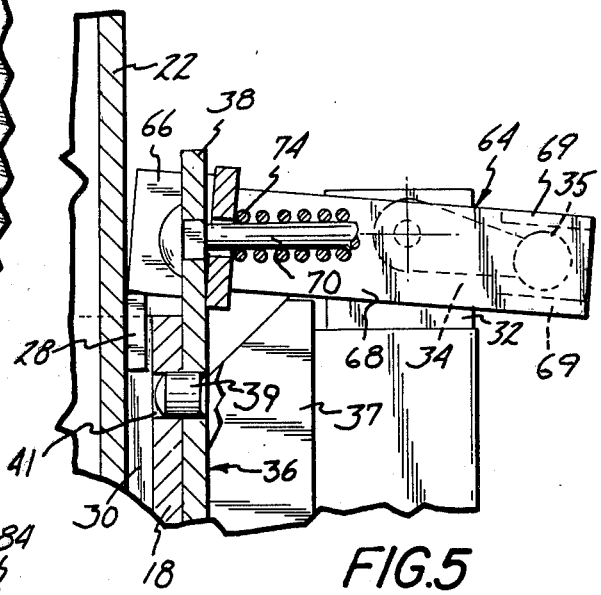
FIG. 5
FIG. 6
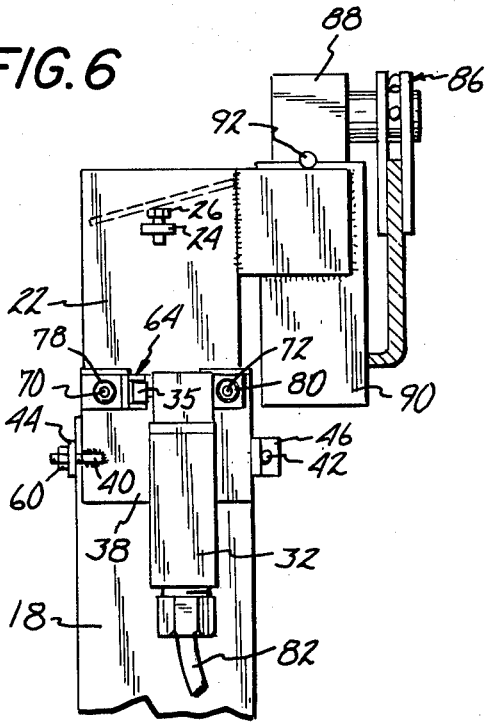
FIG. 4
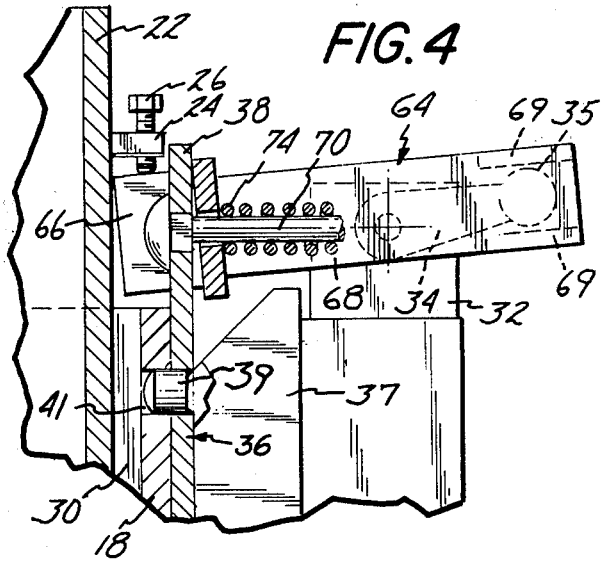

LIMIT SWITCH TRIPPING MECHANISM FOR LIFTING JACKS

This is a divisional application of application Ser. No. 75,652 filed Sept. 14, 1979, assigned to the same assignee as the present invention, which now has issued into U.S. Pat. No. 4,277,656 on July 7, 1981.

BACKGROUND OF THE INVENTION

1. Field of the Invention

The present invention relates to power lifting jacks and in particular to power lifting jacks that have their upward and downward travel distances automatically controlled by a limit switch.

2. Description of the Prior Art

Grain bins, silos and other such structures are constructed through the use of powered lifting jacks. These jacks are attached to the inside of the structure and are synchronously operated to lift an upper section of the structure so that a lower section may be constructed and attached to the underside of the upper section. The jacks are then lowered to set the newly constructed section on the ground and to be detached from the upper section, and are then attached to the newly constructed lower section. The jacks now lift the structure by the newly constructed section so that yet another section can be attached below the section attached to the lifting jacks. This is repeated until a desired height of the bin, silo or other structure is achieved.

It is important for the sake of efficiency and the stability of raising the structure that the operation of the jacks be coordinated, and that the extent of their upward and downward travel be limited. Electric limit switches have been used in some applications to provide these upper and lower limits and to shut off the power to the lifting jacks when either limit is reached.

One type of lifting jack used in the past had a rod fixedly attached to the moving member of the jack, and a limit switch fixedly attached to the non-moving member. Up and down stops on the rod would trip the limit switch when the upper or lower limit of travel of the moving member of the jack had been reached. Several problems, however, have been encountered with this arrangement. First, the rods would occasionally get bent in transportation or from abuse of the equipment and would trip the limit switch prematurely, or not trip it at all. The delay in resetting the limit switches or straightening out the rod can be costly since there is an entire work crew at the construction site. Second, the adjustment of the rods and limit switches was difficult. Third, variation in tolerances of the inner and outer members of the jack could adversely affect the operation of the limit switch. There has been a continuing need for an improved limit switch for use with lifting jacks.

SUMMARY OF THE INVENTION

The lifting jack of the present invention includes a base, an upright outer member rigidly connected to the base, and an upright inner member movable coaxially within the outer member. An up stop and a down stop are rigidly connected to the movable inner member. A guide is pivotally connected to a removable mount that is fixedly attached to the outer member. The guide is normally perpendicular to the travel of the inner member and has a stop engaging member which is positioned to engage the up stop and the down stop. The guide also has an arm guiding portion which engages and guides an actuating arm of a limit switch, which is mounted on the removable mount. When not engaging either the up stop or the down stop, the guide is spring biased in a normal position generally perpendicular to the direction of travel and riding on the inner member of the lifting jack.

The up stop of the present invention is preferably a metal plate rigidly attached to the upright inner member. When the up stop connected to and traveling with the inner member engages the stop engaging member of the guide it pushes the stop engaging member upward and the guiding portion of the guide downward because of the pivotal connection of the guide. The guiding portion thereby guides the actuating arm of the limit switch to a lower position which causes a change of state of the limit switch.

Similarly, when the down stop, connected to and traveling with the inner member, engages the stop engaging member of the guide, it pushes the stop engaging member downwardly, thereby causing the guiding portion of the guide to move upwardly due to the pivotal connection of the guide. The guiding portion thereby guides the actuating arm to an upper position which causes the limit switch to change state.

In a preferred embodiment of the invention, the downward movement may be adjusted by turning a bolt that is threaded through the down stop thereby having the end of the bolt engaging the stop engaging member of the guide.

BRIEF DESCRIPTION OF THE DRAWINGS

FIG. 1 is a perspective view of the lifting jack of the present invention.

FIG. 4 is a view of the same section shown in FIG. 3 except that the down stop is engaged and the arm guiding portion and the actuating arm are in an upper position.

FIG. 5 is a view of the same section shown in FIG. 3 except that the up stop is engaged and the arm guiding portion and the actuating arm are in a lower position.

FIG. 6 is a view taken along the line 6—6 in FIG. 1.

DETAILED DESCRIPTION OF THE PREFERRED EMBODIMENT

Figure 2:
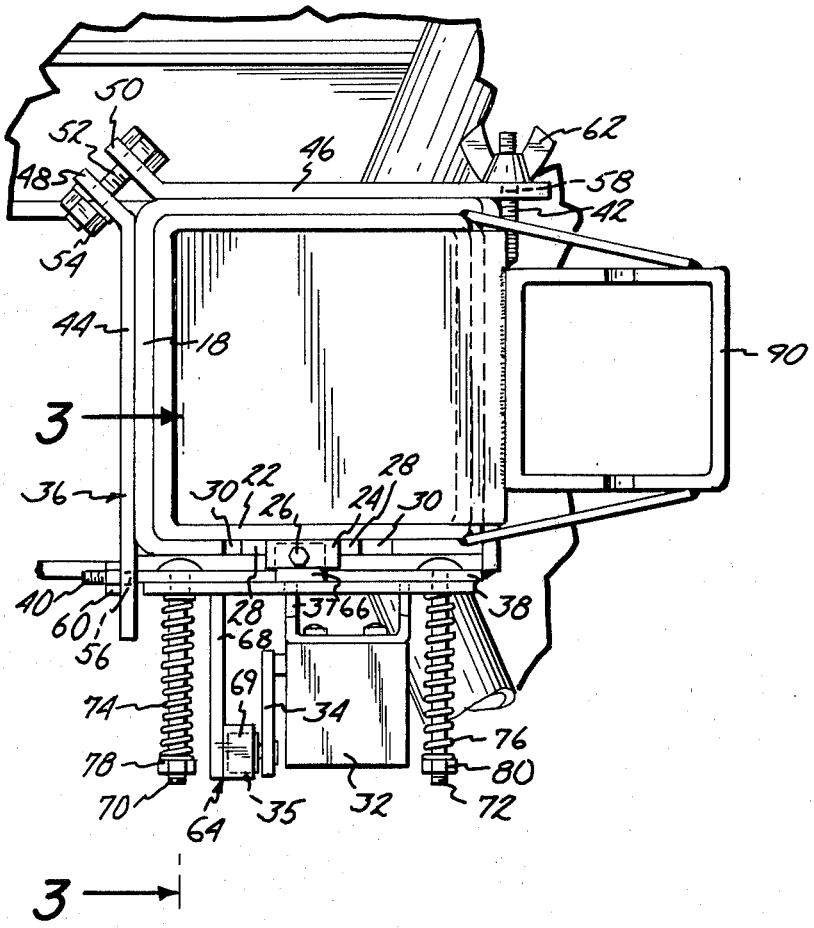
FIG. 2 is a top view of the upper portion of the lifting jack shown in FIG. 1.

In FIG. 1, a lifting jack 10 of the present invention is shown lifting a bin wall 11. Jack 10 includes a base 12 having two opposing substantially horizontal rigid members 14 and a third substantially horizontal member 16 perpendicular to the axis of the two members 14. The horizontal members 14 are positioned generally parallel to the bin wall. In the preferred embodiment shown in FIG. 1, the horizontal members 14 are made of angle iron and the horizontal member 16 is a welded structure, but any suitable rigid material providing the required support can be substituted.

An upright outer member 18 is rigidly attached to the base 12 and extends upward from it. A pair of braces 20 are rigidly attached to the horizontal members 14 at one end and to the upright outer member 18 at the other end to provide additional support to the lifting jack 10.

Figure 3:
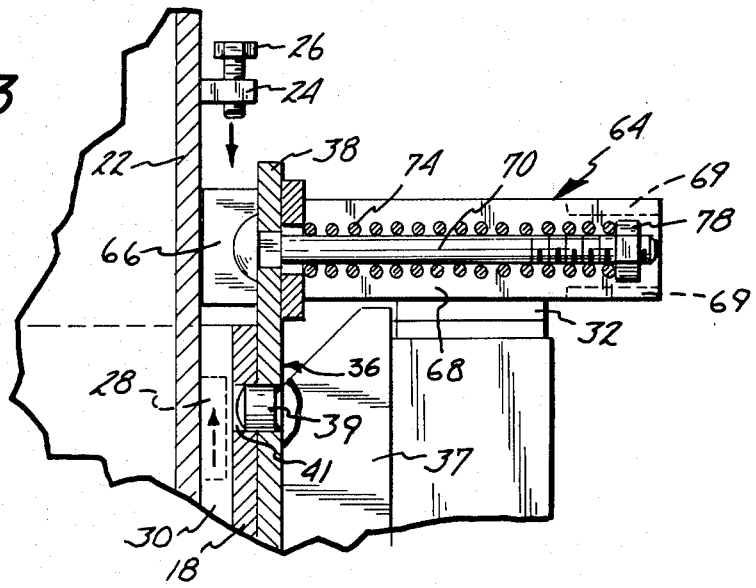
FIG. 3 is a cross-sectional view taken along the line 3—3 in FIG. 2 showing the guide in a normal position.

An upright inner member 22 movable coaxially within the upright outer member 18 provides the lifting action of lifting jack 10. A down stop 24 is rigidly attached to the inner member 22 and preferably has a downward facing aperture with an adjusting bolt 26 threaded in a downward direction. The inner member also has an up stop 28 rigidly attached as best shown in FIGS. 3 and 5. The up stop 28 travels within a relief slot 30 of the outer member 18. The up stop 28 and the down stop 24 are preferably made of metal.

A limit switch 32 has an actuating arm 34 with a roller member 35 rotatably attached on a free end of arm 34. The limit switch 32 is attached to a removable mount 36 as best seen in FIG. 2. The actuating arm 34 is shown in a normal position in FIG. 3 and has a capability of being moved to either an upper position, as shown in FIG. 4, or a lower position, as shown in FIG. 5. When arm 34 is moved to either the upper or lower position, it causes limit switch 32 to change electrical state from its normal state when arm 34 is in its normal position.

The limit switch 32 is preferably fixedly attached to a short section of channel iron 37, which in turn is rigidly attached to a primary plate 38. The primary plate 38 has a location or pilot peg 39 permanently attached. The peg 39 pilots into aperture 41 in outer member 18 and positions the primary plate 38 in an exact relationship between the up stop 28 and the down stop 24. The switch 32 and its mounting can thus be transferred to any jack of the present design having an aperture 41, and the switch will be properly located for use. The primary plate 38 has two integral sections perpendicular to each other and engages approximately one-half of the perimeter of the outer member 18 and extends upwardly past the upper horizontal end plane of the outer member 18. The primary plate 38 has rigidly attached substantially horizontal bolts 40 and 42 extending outwardly from each end. The removable mount 36 also includes strapping plates 44 and 46 engaging the remainder of the perimeter of the outer member 18. Strapping plates 44 and 46 have ends 48 and 50 that are bent away from the outer member 18 and face each other. The ends 48 and 50 are bent so that there is a small distance between them. A bolt 52 passes through an aperture contained in each end 48, 50 and with a nut 54 is used to tighten the two strapping plates 44 and 46 toward each other. The strapping plates 44 and 46 also have apertures 56 and 58 through which the bolts 40 and 42 of primary plate 38 pass through. Nuts 60 and 62 are threaded on bolts 40 and 42 to secure strapping plate 44 to one end of primary plate 38 and strapping plate 46 to the other end of primary plate 38. As can be seen, nut 54 and wing nut 62 may be loosened and the mount may be easily removed from the outer member 18.

A guide 64 as best seen in FIGS. 2 and 3 has a stop engaging member 66 at one end closest to inner member 22, and a guiding portion 68 at its opposite end. The guide 64 is generally perpendicular to the travel of the inner member 22 and is pivotally attached to the removable mount 36 above the horizontal end plane of the outer member 18. The stop engaging member 66 is riding on the inner member 22 with spring tension provided by garter springs 74 and 76. However, the up and down stops 28 and 24 are large enough to ensure engagement with stop engaging member 66. The guiding portion 68 engages the roller 35 by a shoe or channel section 69 as shown in FIGS. 3, 4 and 5. The guide 64 is pivotally connected to the removable mount 36 preferably by two outwardly extending bolts 70 and 72 as best shown in FIGS. 2 and 3.

Garter springs 74 and 76 bias guide 64 in a normal position which is generally perpendicular to the direction of travel of the inner member 22. The guide 64, in turn, holds the actuating arm 34 with guiding portion 68 in the normal position. The garter springs 74 and 76 are held in position by nuts 78 and 80 threaded on the end of bolts 70 and 72, respectively.

FIGS. 3, 4 and 5 illustrate the operation of the present invention. In FIG. 3, the normal position of guide 64 and arm 34 is shown. The guide 64 is biased by garter springs 74 and 76 in the normal position when the down stop 26 or the up stop 28 is not engaging stop engaging member 66.

As shown in FIG. 4, as the inner member 22 moves in a downward direction it eventually brings down stop 24 into engagement with stop engaging member 66 of guide 64. The length of travel of the inner member in a downward direction may be adjusted by turning bolt 26 through down stop 24 so that the end of bolt 26 will come in contact with the stop engaging member 66. FIG. 4 shows the end of bolt 26 engaging the top of stop engaging member 66 and pivoting member 66 in a downward direction thereby causing guiding portion 68 and shoe section 69 to move upward and guide the actuating arm 34 by roller 35 of the limit switch 32 to the upper position.

Similarly, as shown in FIG. 5, the inner member 22 moving in an upward direction eventually brings up stop 28 into engagement with the bottom of stop engaging member 66 and pivots guiding portion 68 and shoe section 69 in a downward direction, thereby moving the actuating arm 34 by roller 35 to the lower position.

The limit switch 32 is conductively connected, as shown in FIG. 1, by an electrical conductor 82 to controls of a power supply (not shown) such as an electric motor. The electric motor in turn transmits power to a plurality of drive shafts 84 which in turn synchronously operate a plurality of lifting jacks spaced around the inner periphery of the bin wall 11. The actuating arm 34 moved into either the upper or lower position by the engagement of the stop engaging member 66 and the down stop 24 or the up stop 28 will provide a control signal to halt the power to lifting jack 10.

An attaching member 86 is secured to the wall 11 of a bin or silo. In one preferred embodiment, as shown in FIG. 6, the attaching member 86 is ridigly attached to a lift tube 88. The lift tube 88 moves within an outer tube 90 that is rigidly attached to the upright inner member 22. The height of the attaching member 86 may be adjusted by a plurality of apertures (not shown) through which a pin 92 can be inserted adjusting the height that the lift tube 88 is protruding from the outer tube 90. This additional height adjustment allows for more flexibility in operating the lifting jack of the present invention.

The combination of the down stop 24 and the up stop 28 being made of a metal plate and the mounting of the limit switch 32 and the guide 64 on a removable mount 36 which can be removed from the jack make the present invention ideally suited for the rough handling that may occur in transportation or in operation of the lifting jack. Further, the removable mount 36 allows the use of the limit switch and the guide 64 interchangeably on various jacks, which provides the user with greater flexibility.

The guide being perpendicular to the travel of the inner member 22 and the rigidly attached stops 24, 28 negates the possibility of premature tripping of the limit switch 32 since the guide is riding on the inner member 22 and will float perpendicular to the travel of the inner member 22. The only condition that will cause the guide to move to trip the limit switch 32 is during engagement of the down stop 24 or the up stop 28 with stop engaging member 66.

Lastly, the present invention solves the tolerance problem inherent in the lifting jacks. The lifting jacks are typically not manufactured to close tolerances, consequently the inner member 22 will have some play within the outer member 18 and the amount will vary from jack to jack. A mechanical tripping mechanism fixedly attached to both outer and inner members could cause premature tripping of the limit switch 32. However, in the present invention the stop engaging member of the guide slides on and floats over imperfections of the inner member 22 until it is engaged with the up stop 28 or down stop 24.

Although the present invention has been found to be particularly useful for lifting jacks, the scope should not be limited to such. The present invention contemplates other applications with a stationary member and a movable member having a need for a limit switch tripping mechanism as described above. Persons skilled in the art will recognize that changes may be made in form and detail without departing from the spirit and scope of the invention.

What is claimed is:

1. A lift jack comprising:

a base;

an upstanding outer member rigidly connected to the base;

an upstanding inner member movable coaxially within the outer member;

a first stop on the inner member;

mounting means fixedly attached to the outer member;

limit switch means mounted in a fixed position to the stationary member and having an actuating arm with a normal position and a first position on one side of the normal position;

guide means having a stop engaging member for engaging the first stop and an arm guiding portion for guiding the actuating arm;

pivotal connecting means pivotally connecting the guide means to the mounting means and allowing the guide means to pivot at a point between the stop means and the guiding portion when the stop engaging member engages the first stop so that the guiding portion guides the actuating arm to a first position which changes state of the limit switch means; and spring bias means for biasing the guide means to hold the actuating arm in a normal position.

2. The lift jack of claim 1 further comprising a second stop on the inner member.

3. The lift jack of claim 2 wherein the first stop is an up stop on the inner member and the second stop is a down stop on the inner member, and the actuating arm of the limit switch means is guided by the guiding portion to a lower position by engagement of the up stop with the stop engaging member and is guided by the guiding portion to an upper position by engagement of the down stop with the stop engaging member.

4. The lift jack of claim 1 wherein the guide means is substantially perpendicular to the travel of the upright inner member and the first stop.

* * * * *